US006006047A

United States Patent [19]

Mara et al.

[11] Patent Number: 6,006,047

[45] Date of Patent: Dec. 21, 1999

[54] APPARATUS FOR MONITORING AND CONTROLLING ELECTRICAL PARAMETERS OF AN IMAGING SURFACE

[75] Inventors: Robert M. Mara, Fairport; Barbara A. Sampath, Geneseo; Lai C. Lam, Webster; Patrick O. Waller, Rochester; Joseph A. Mastrandrea, Webster, all of N.Y.

[73] Assignee: Xerox Corporation, Stamford, Conn.

[21] Appl. No.: 08/974,448

[22] Filed: Nov. 20, 1997

Related U.S. Application Data

[63] Continuation-in-part of application No. 08/618,176, Mar. 19, 1996, abandoned.

[51] Int. Cl.[6] ..... G03G 15/00

[52] U.S. Cl. ..... 399/49; 399/48; 399/50; 399/51; 399/53

[58] Field of Search ..... 399/49, 50, 51, 399/53, 46, 48

[56] References Cited

U.S. PATENT DOCUMENTS

| | | | |
|---|---|---|---|
| 4,341,461 | 7/1982 | Fantozzi | 399/49 |
| 4,348,099 | 9/1982 | Fantozzi | 399/49 X |
| 5,689,763 | 11/1997 | Rathbun et al. | 399/53 |
| 5,903,796 | 5/1999 | Budnik et al. | 399/49 X |
| 5,937,229 | 8/1999 | Walgrove et al. | 399/46 X |

*Primary Examiner*—Susan S.Y. Lee
*Attorney, Agent, or Firm*—Lloyd F. Bean II

[57] ABSTRACT

An apparatus for monitoring and controlling electrical parameter of an imaging surface, the monitoring controlling apparatus including a patch generator for recording a first control patch at a first voltage level and a second control patch at a second voltage level on the imaging surface; electrostatic voltmeter for measuring voltage potentials associated with the first control patch and second control patch. A processor, in communication with the patch generator, calculates the electrical parameters of the imaging surface from the measured voltage potentials from the first and second control patches. The processor determines a deviation between the calculated electrical parameters values and setup values. Then, the processor produces and sends a feedback error signal to the patch generator if the deviation exceed a threshold level. The patch generator records a third control patch at a third voltage level on the imaging surface upon reception of the error signal. The ESV senses the third control patch. The processor calculates the electrical parameters of the imaging surface from the measured voltage potential of the third control patch and determines a correction factor. The charging device, exposure system and developer are adjusted in accordance to the correction factor.

6 Claims, 12 Drawing Sheets

APPARATUS FOR MONITORING AND CONTROLLING ELECTRICAL PARAMETERS OF AN IMAGING SURFACE

This application is a continuation-in-part of originally filed Ser. No. 08/618,176, filed on Mar. 19, 1996, now abandoned.

The present invention relates generally to an electrostatographic printing machine and, more particularly, concerns a process control system, preferably for use in an electrophotographic printing machine.

The basic reprographic process used in an electrostatographic printing machine generally involves an initial step of charging a photoconductive member to a substantially uniform potential. The charged surface of the photoconductive member is thereafter exposed to a light image of an original document to selectively dissipate the charge thereon in selected areas irradiated by the light image. This procedure records an electrostatic latent image on the photoconductive member corresponding to the informational areas contained within the original document being reproduced. The latent image is then developed by bringing a developer material including toner particles adhering triboelectrically to carrier granules into contact with the latent image. The toner particles are attracted away from the carrier granules to the latent image, forming a toner image on the photoconductive member which is subsequently transferred to a copy sheet. The copy sheet having the toner image thereon is then advanced to a fusing station for permanently affixing the toner image to the copy sheet in image configuration.

The approach utilized for multicolor electrostatographic printing is substantially identical to the process described above. However, rather than forming a single latent image on the photoconductive surface in order to reproduce an original document, as in the case of black and white printing, multiple latent images corresponding to color separations are sequentially recorded on the photoconductive surface. Each single color electrostatic latent image is developed with toner of a color complimentary thereto and the process is repeated for differently colored images with the respective toner of complimentary color. Thereafter, each single color toner image can be transferred to the copy sheet in superimposed registration with the prior toner image, creating a multi-layered toner image on the copy sheet. Finally, this multi-layered toner image is permanently affixed to the copy sheet in substantially conventional manner to form a finished color copy.

In electrostatographic machines using a drum-type or an endless belt-type photoconductive member, the photosensitive surface thereof can contain more than one image at one time as it moves through various processing stations. The portions of the photosensitive surface containing the projected images, so-called "image areas" or "pitches", are usually separated by a segment of the photosensitive surface called an inter-document space. After charging the photosensitive surface to a suitable charge level, the inter-document space segment of the photosensitive surface is generally discharged by a suitable lamp to avoid attracting toner particles at the development stations. Various areas on the photosensitive surface, therefore, will be charged to different voltage levels. For example, there will be the high voltage level of the initial charge on the photosensitive surface, a selectively discharged image area of the photosensitive surface, and a fully discharged portion of the photosensitive surface between the image areas.

A flexible photoreceptor belt, one type of photoconductive imaging member, is typically multi-layered and has a substrate, a conductive layer, an optional hole blocking layer, an optional adhesive layer, a charge generating layer, a charge transport layer, and, in some embodiments, an anti-curl backing layer or a protective overcoat. High speed electrophotographic copiers and printers use flexible photoreceptor belts to produce high quality toner images. During extended cycling of the belts, a level of reduced life is encountered, which requires belt replacement in order to continue producing high quality toner images. As a result, photoreceptor characteristics that affect the image quality of toner output images as well as photoreceptor end of life, have been identified. Photoreceptor characteristics that affect image quality include; charge acceptance when contacted with a given charge, dark decay in rested (first cycle) and fatigued state (steady state), the discharge or photo induced discharge characteristics (PIDC) which is the relationship between the potential remaining as a function of light intensity, the spectral response characteristics and the residual potential. As photoreceptors age, they undergo conditions known as cycle-up and cycle-down. Cycle-up (residual rise) is a phenomenon in which residual potential and/or background potential keeps increasing as a function of cycles, which generally leads to increased and unacceptable background density in copies of documents. Cycle-down is a phenomenon in which the dark development potential (potential corresponding to unexposed regions of the photoreceptor) keeps decreasing as a result of dark decay as a function of cycles, which generally leads to reduced image densities in the copies of documents.

Heretofore, various method have been employed to control the electrical parameter of a photoconductive surface to ensure high print quality. Many of the methods employ one or more test patches (or sometimes referred to as control patches) on the photoconductive surface usually in the interdocument zone upon which electrical properties can be measured by capacitively coupled probes. The photoreceptor is rotated for several cycles to measure the test patch under different electrical conditions (i.e. charging potentials and exposures) for each cycle once a sufficient number of measurement points (i.e. data) are taken. A process control algorithm that resides in the control electronics uses the obtained data to predict the generalized average electrical characteristics of the entire photoreceptor. Then, the control electronics continually adjust the charging currents and the light exposure ranges so that the photoconductive surface has consistent development field.

Various systems have been designed and implemented for controlling charging processes within a printing machine. The present invention describes a method for monitoring and controlling the electrical parameter of a photoconductive member. The following disclosures may be relevant to various aspects of the present invention:

U.S. Pat. No. 4,355,885

Patentee: Nagashima

Issued: Oct. 26, 1982

U.S. Pat. No. 5,191,293

Inventor: Kreckel

Filed: Aug. 30, 1991

The relevant portions of the foregoing disclosures may be briefly summarized as follows:

U.S. Pat. No. 4,355,885 discloses an image forming apparatus having a surface potential control device wherein a magnitude of a measured value of the surface potential measuring means and an aimed or target potential value are differentiated. The surface potential control device may repeat the measuring, differentiating, adding and subtracting operations, and can control the surface potential within a predetermined range for a definite number of times.

U.S. Pat. No. 5,191,293 is directed toward a method for determining photoreceptor potentials wherein a surface of the photoreceptor is charged at a charging station and the charged area is rotated and stopped adjacent an electrostatic voltmeter. An electrostatic voltmeter provides measurements at different times, for determining a dark decay rate of the photoreceptor, which allows for calculation of surface potentials at other points along the photoreceptor belt.

In accordance with one aspect of the present invention, there is provided an apparatus for monitoring and controlling electrical parameter of an imaging surface, the monitoring controlling apparatus including a patch generator for recording a first control patch at a first voltage level and a second control patch at a second voltage level on the imaging surface; electrostatic voltmeter for measuring voltage potentials associated with said first control patch and second control patch. A processor, in communication with said patch generator, calculates the electrical parameters of the imaging surface from the measured voltage potentials from said first and second control patches. The processor determines a deviation between the calculated electrical parameters values and setup values. Then, the processor produces and sends a feedback error signal to said patch generator if said deviation exceed a threshold level. The patch generator records a third control patch at a third voltage level on the imaging surface upon reception of said error signal The ESV senses said third control patch. The processor calculates the electrical parameters of the imaging surface from the measured voltage potential of the third control patch and determines a correction factor. The charging device, exposure system and developer are adjusted in accordance to said correction factor.

Other features of the present invention will become apparent as the following description proceeds and upon reference to the drawings, in which.

While the present invention is described hereinafter with respect to a preferred embodiment, it will be understood that this detailed description is not intended to limit the scope of the invention to that embodiment. On the contrary, the description is intended to include all alternatives, modifications and equivalents as may be considered within the spirit and scope of the invention as defined by the appended claims.

Figure 4:
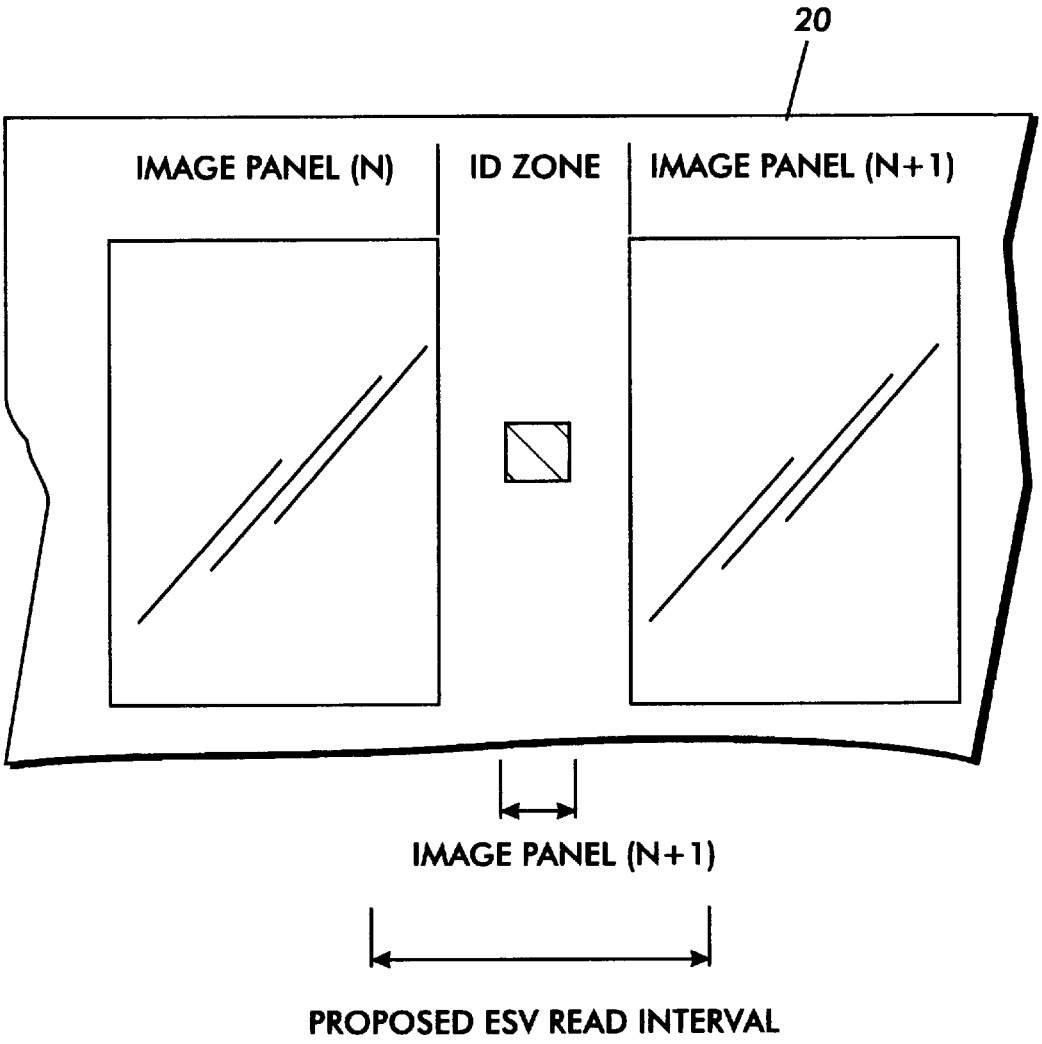
FIG. 4 is an enlarged view of FIG. 2.

For a general understanding of the features of the present invention, reference is made to the drawings wherein like references have been used throughout to designate identical elements. A schematic elevational view showing an exemplary electrophotographic printing machine incorporating the features of the present invention therein is shown in FIG. 4. It will become evident from the following discussion that the present invention is equally well-suited for use in a wide variety of printing systems including ionographic printing machines and discharge area development systems, as well as other more general non-printing systems providing multiple or variable outputs such that the invention is not necessarily limited in its application to the particular system shown herein.

Figure 3:
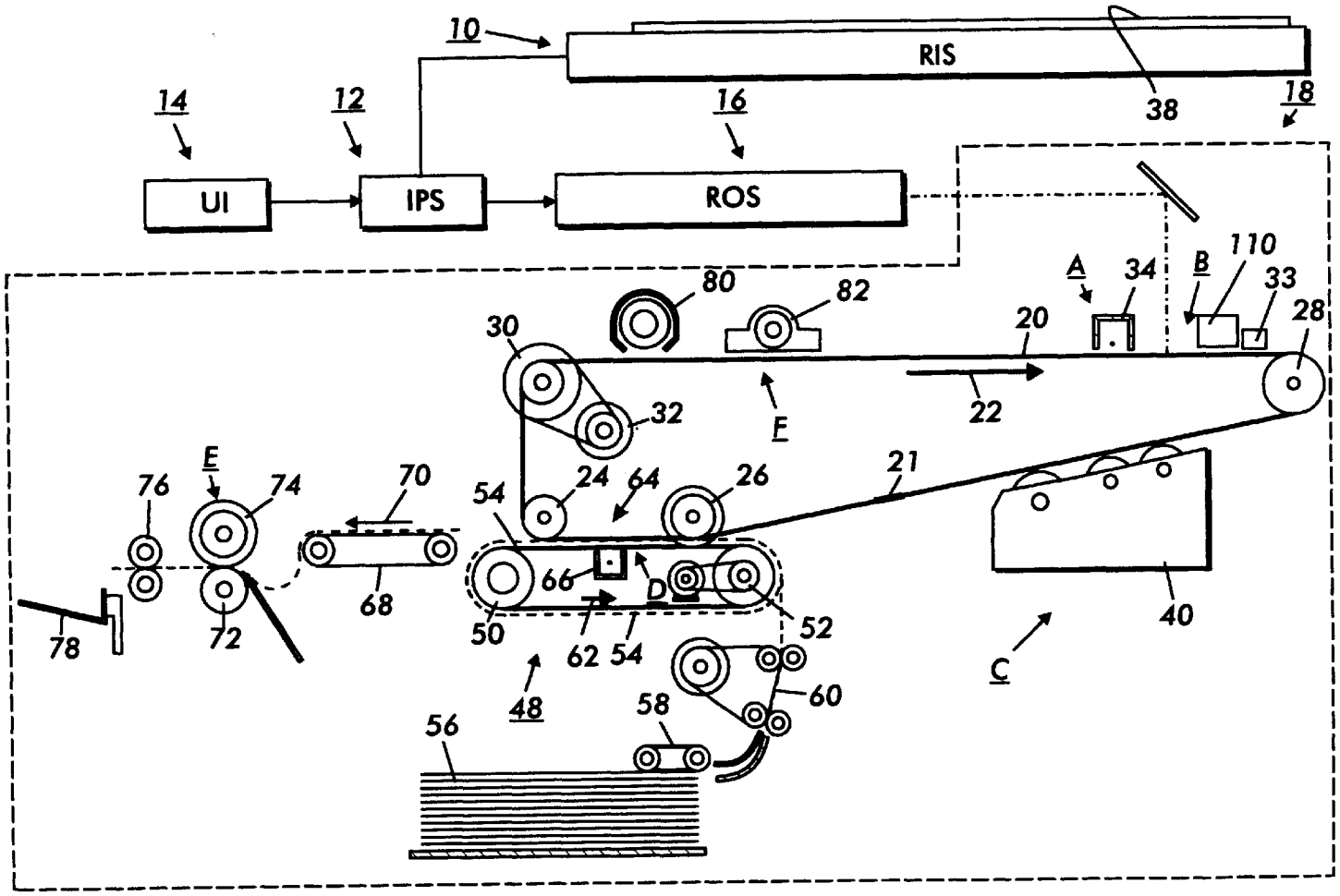
FIG. 3 is a schematic elevational view of an exemplary electrophotographic printing machine incorporating the features of the present invention therein.

Turning initially to FIG. 3, before describing the particular features of the present invention in detail, an exemplary electrophotographic copying apparatus will be described. The exemplary electrophotographic system may be a copier, as for example, the Xerox Corporation "5090" copier. To initiate the copying process, a multicolor original document 38 is positioned on a raster input scanner (RIS), indicated generally by the reference numeral 10. The RIS 10 contains document illumination lamps, optics, a mechanical scanning drive, and a charge coupled device (CCD array) for capturing the entire image from original document 38. The RIS 10 converts the image to a series of raster scan lines and measures a set of primary color densities, i.e. red, green and blue densities, at each point of the original document. This information is transmitted as an electrical signal to an image processing system (IPS), indicated generally by the reference numeral 12, which converts the set of red, green and blue density signals to a set of colorimetric coordinates. The IPS contains control electronics for preparing and managing the image data flow to a raster output scanner (ROS), indicated generally by the reference numeral 16.

A user interface (UI), indicated generally by the reference numeral 14, is provided for communicating with IPS 12. UI 14 enables an operator to control the various operator adjustable functions whereby the operator actuates the appropriate input keys of UI 14 to adjust the parameters of the copy. UI 14 may be a touch screen, or any other suitable device for providing an operator interface with the system. The output signal from UI 14 is transmitted to IPS 12 which then transmits signals corresponding to the desired image to ROS 16. ROS 16 includes a laser with rotating polygon mirror blocks. The ROS 16 illuminates, via mirror 37, a charged portion of a photoconductive belt 20 of a printer or marking engine, indicated generally by the reference numeral 18. Preferably, a multi-facet polygon mirror is used to illuminate the photoreceptor belt 20 at a rate of about 400 pixels per inch. The ROS 16 exposes the photoconductive belt 20 to record latent image thereon corresponding to the signals transmitted from IPS 12.

With continued reference to FIG. 3, marking engine 18 is an electrophotographic printing machine comprising photoconductive belt 20 having a seam 21 which is entrained about transfer rollers 24 and 26, tensioning roller 28, and drive roller 30. Drive roller 30 is rotated by a motor or other suitable mechanism coupled to the drive roller 30 by suitable means such as a belt drive 32. As roller 30 rotates, it advances photoconductive belt 20 in the direction of arrow 22 to sequentially advance successive portions of the photoconductive belt 20 through the various processing stations disposed about the path of movement thereof. Photoconductive belt 20 is preferably made from a polychromatic photoconductive material comprising an anti-curl layer, a supporting substrate layer and an electrophotographic imaging single layer or multi-layers. The imaging layer may contain homogeneous or heterogeneous, inorganic or organic compositions. Preferably, finely divided particles of a photoconductive inorganic or organic compound are dispersed in an electrically insulating organic resin binder. Typical photoconductive particles include trigonal selenium, metal free phthalocyanine, copper phthalocyanine, vanadyl phthalocyanine, hydroxy gallium phthalochanine, titanol phthalocyanine, quinacridones, 2, 4-diamino-triazines and polynuclear aromatic quinines. Typical organic resinous binders include polycarbonates, acrylate polymers, vinyl polymers, cellulose polymers, polyesters, polysiloxanes, polyamides, polyurethanes, epoxies, and the like as well as copolymers of the above polymers.

Initially, a portion of photoconductive belt 20 passes through a charging station, indicated generally by the reference letter A. At charging station A, a corona generating device 34 or other charging device generates a charge voltage to charge photoconductive belt 20 to a relatively high, substantially uniform voltage potential. The corona generator 34 comprises a corona generating electrode, a shield partially enclosing the electrode, and a grid disposed between the belt 20 and the unenclosed portion of the electrode. The electrode charges the photoconductive surface of the belt 20 via corona discharge. The voltage potential applied to the photoconductive surface of the belt 20 is varied by controlling the voltage potential of the wire grid.

Next, the charged photoconductive surface is rotated to an exposure station, indicated generally by the reference letter B. Exposure station B receives a modulated light beam corresponding to information derived by RIS 10 having an original document 38 positioned thereat. The modulated light beam impinges on the surface of photoconductive belt 20, selectively illuminating the charged surface of photoconductive belt 20 to form an electrostatic latent image thereon.

A patch generator 110 in the form of a conventional exposure device serves to create control patches at various exposure levels in the interdocument zone; the patches are used in a developed and undeveloped condition for controlling various process functions. However, before reaching the development station C, the photoconductive belt 20 passes subjacent to a voltage monitor, preferably a electrostatic voltmeter 33, for measurement of the voltage potential of control patches at the surface of the photoconductive belt 20. The electrostatic voltmeter 33 can be any suitable type known in the art wherein the charge on the photoconductive surface of the belt 20 is sensed, such as disclosed in U.S. Pat. Nos. 3,870,968; 4,205,257; or 4,853,639, the contents of which are incorporated by reference herein.

Figure 7:
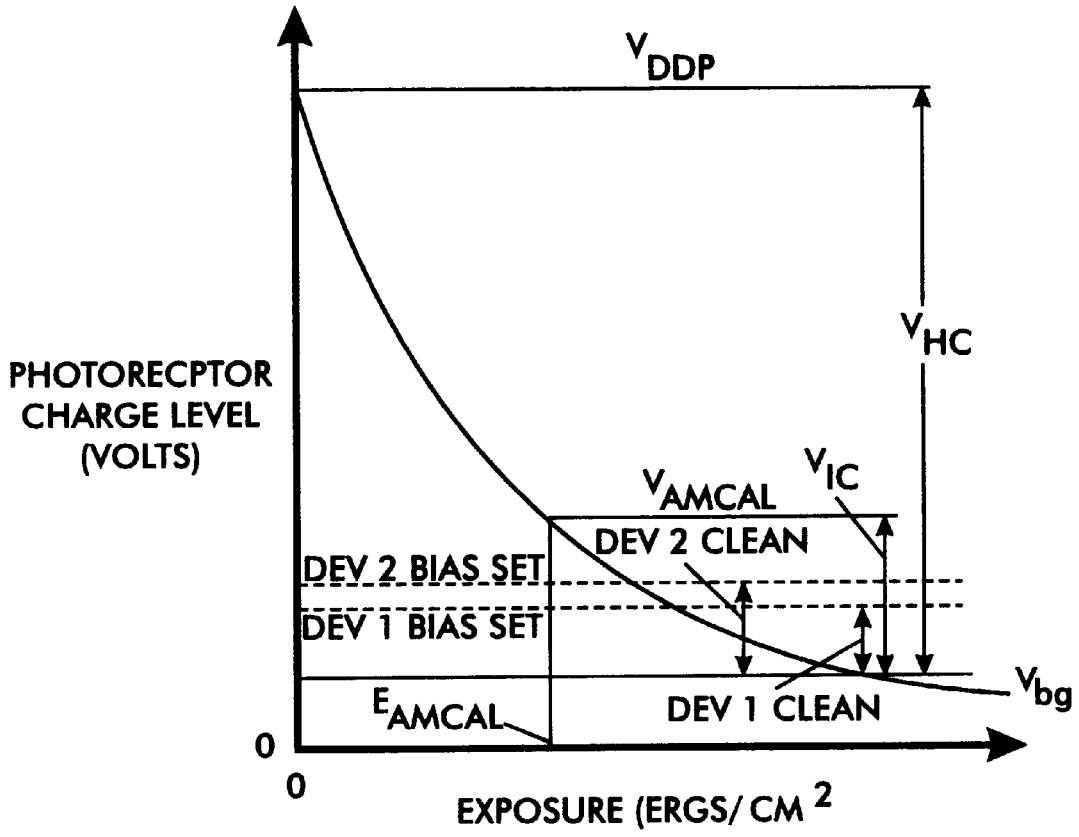
FIG. 7 is a PIDC curve illustrating the relationship of the parameters used with the present invention.
Figure 8:
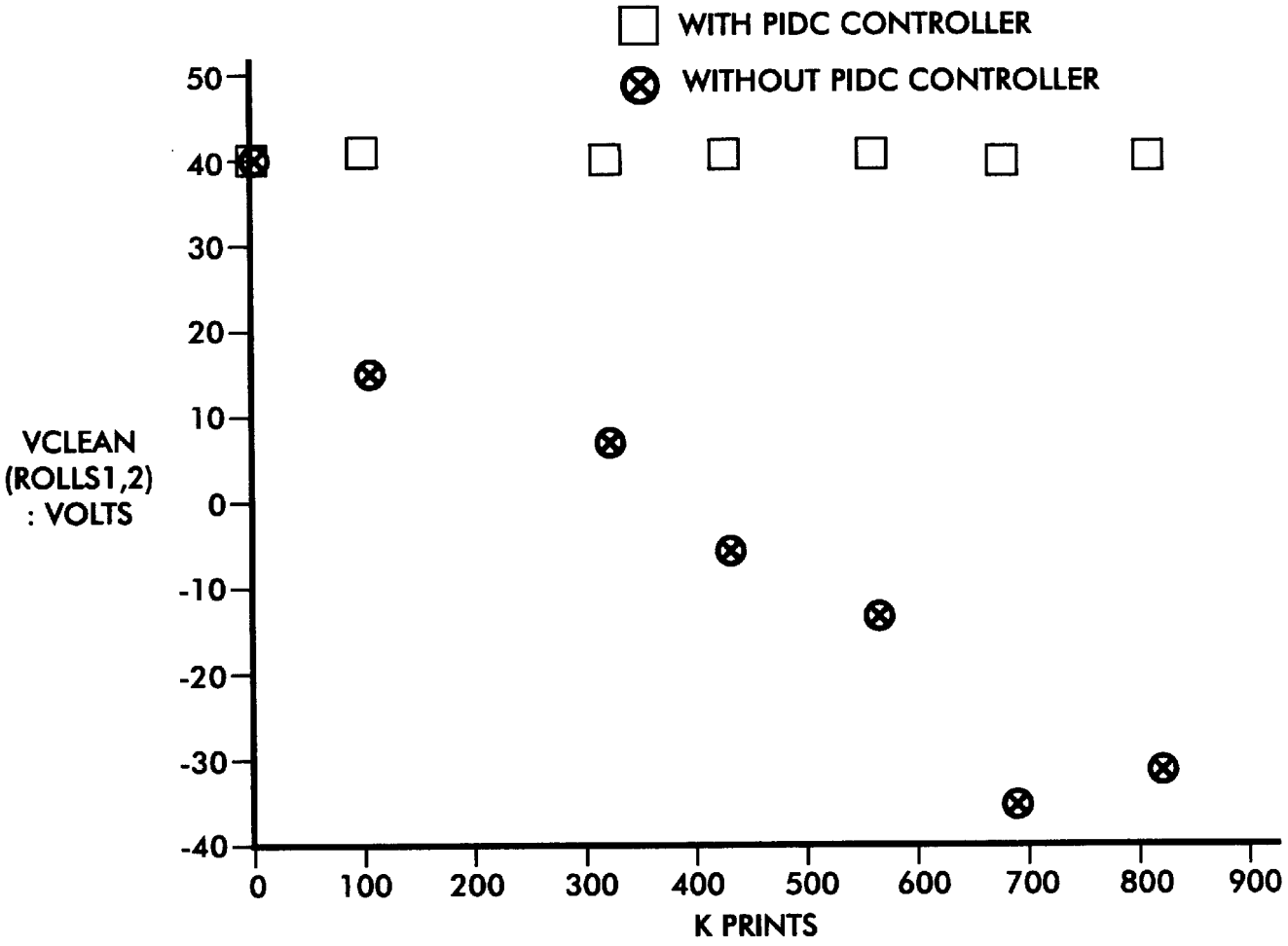
FIGS. 8–13 are comparison, graphical data of a printing machine using the present invention.
Figure 9:
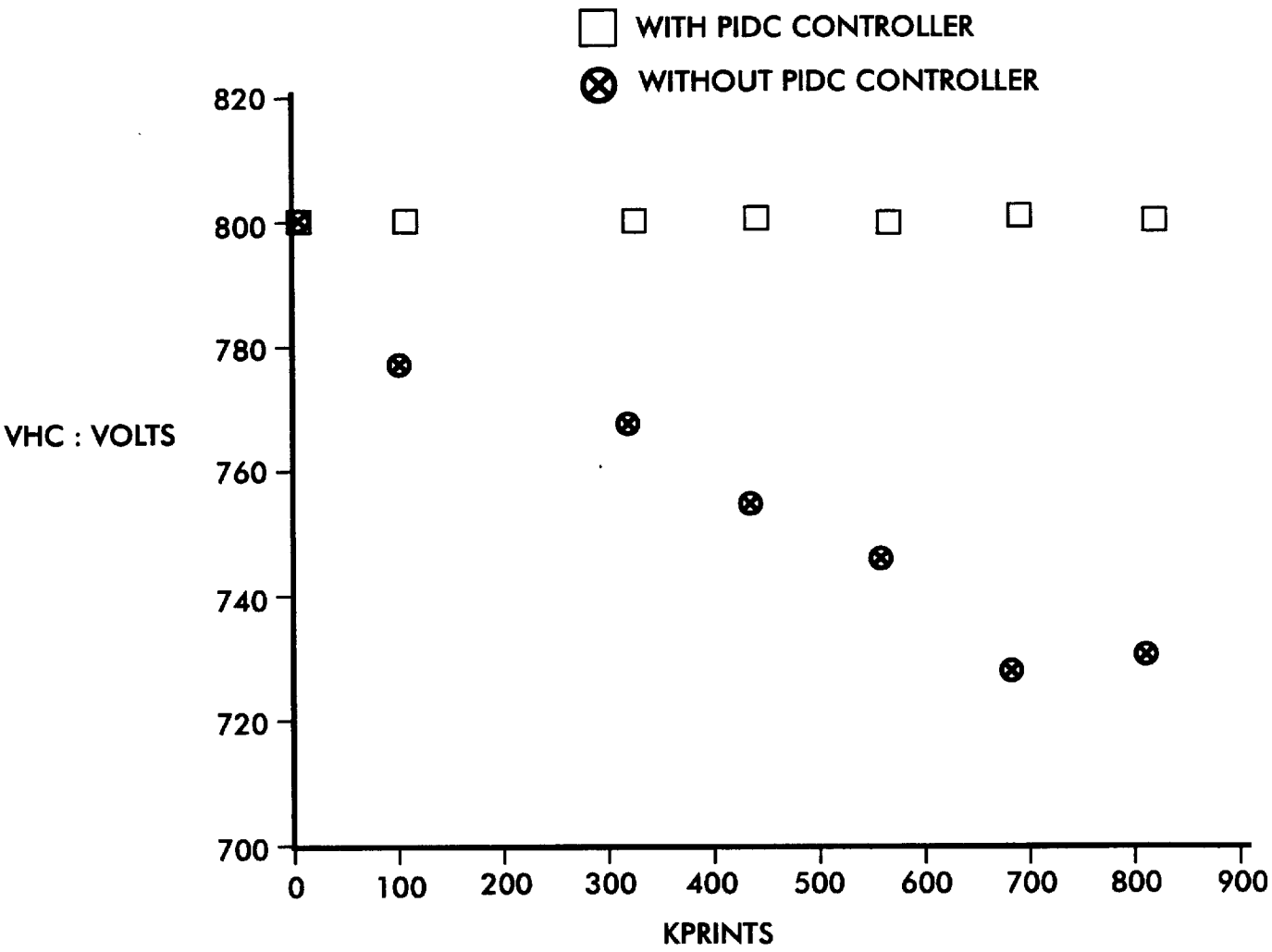
Figure 10:
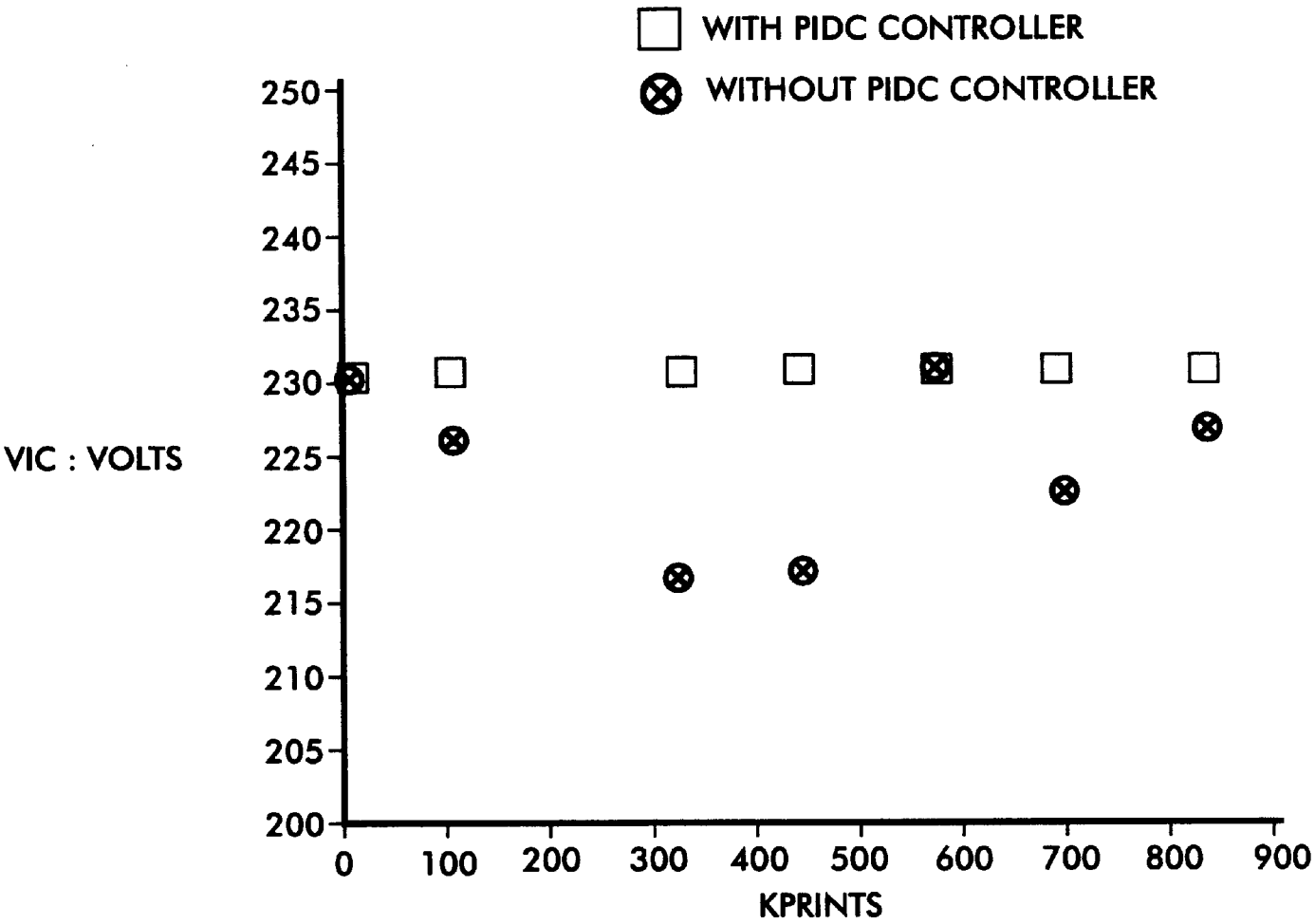
Figure 11:
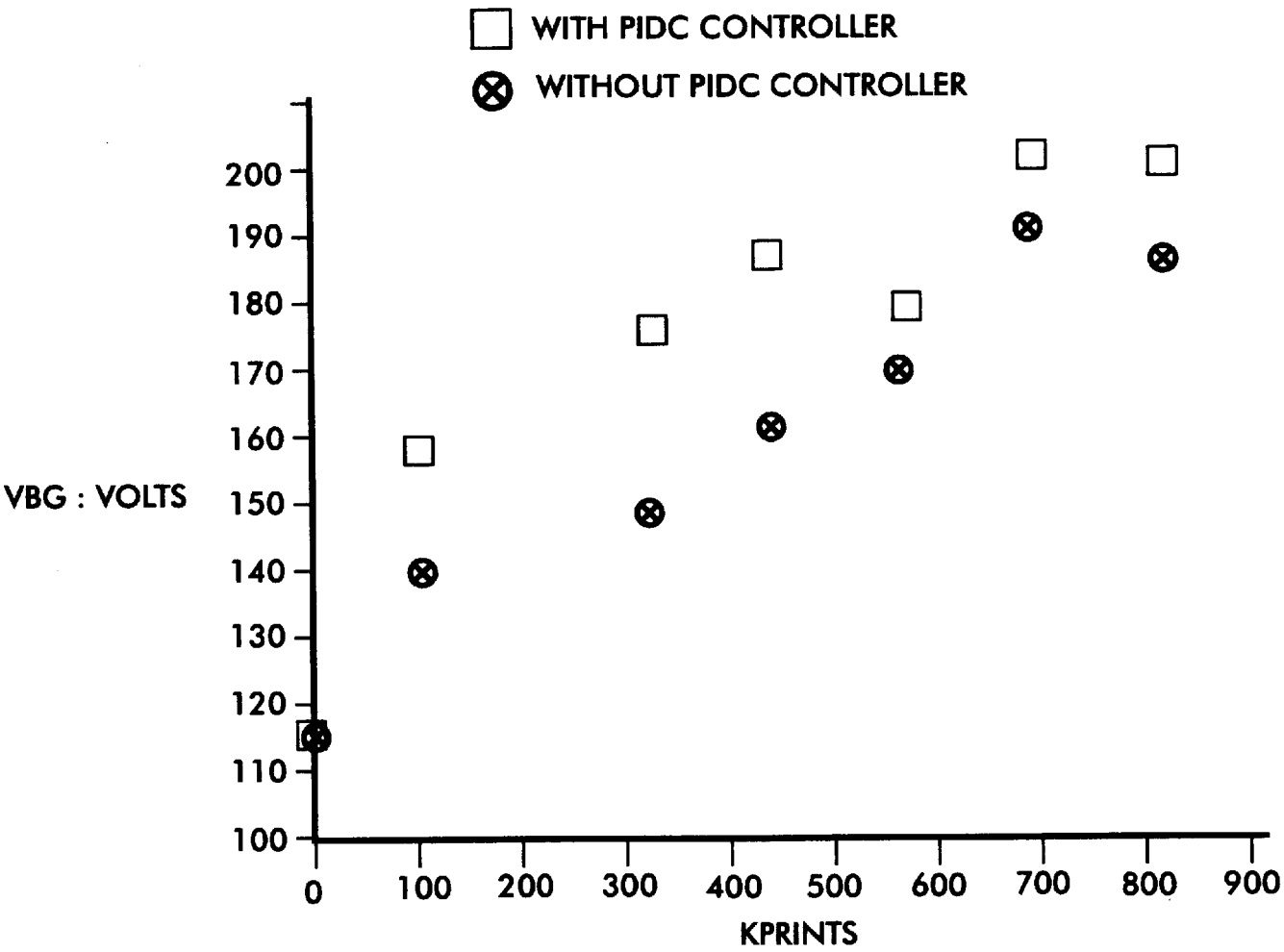
Figure 12:
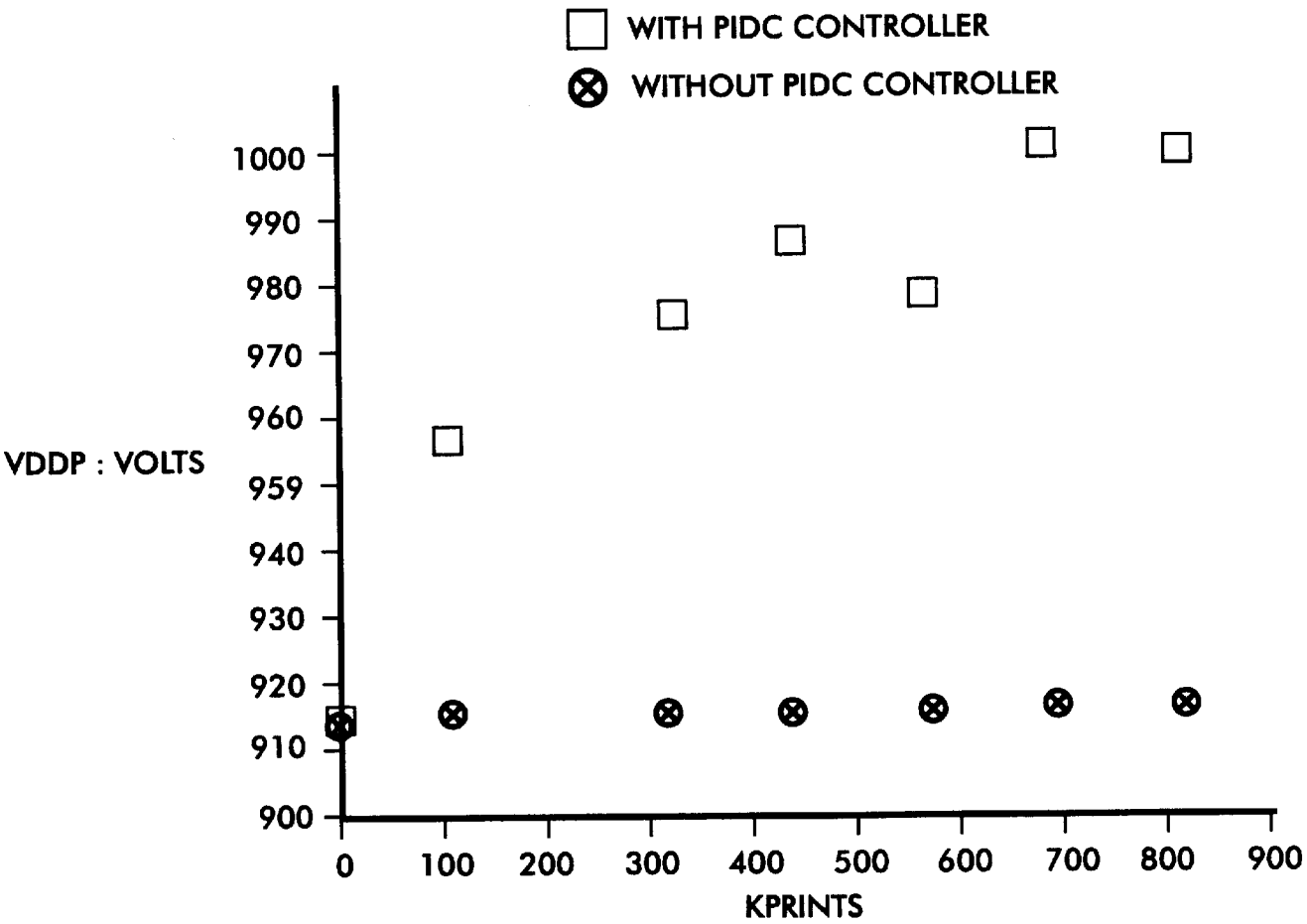
Figure 13:
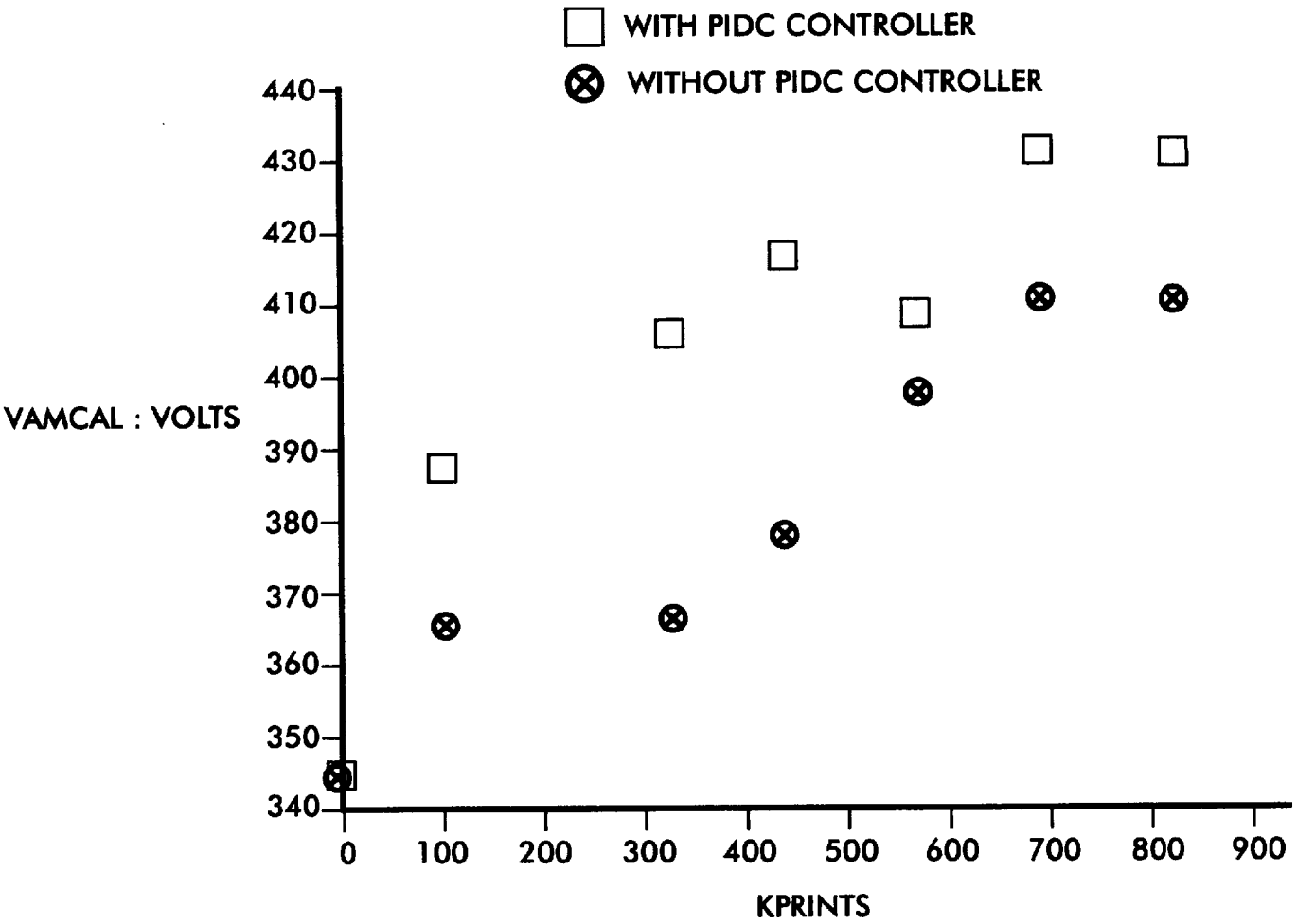

A typical electrostatic voltmeter is controlled by a switching arrangement which provides the measuring condition in which charge is induced on a probe electrode corresponding to the sensed voltage level of a control patch on the belt 20. The induced charge is proportional to the sum of the internal capacitance of the probe and its associated circuitry, relative to the probe-to-measured surface capacitance. A DC measurement circuit is combined with the electrostatic voltmeter circuit for providing an output which can be read by a conventional test meter or input to a control circuit. The voltage potential measurement of control patches on the photoconductive belt 20 is utilized to determine specific parameters such as a PIDC curve as shown in FIG. 7 for maintaining a predetermined potential on the photoreceptor surface.

After the electrostatic latent images have been recorded on photoconductive belt 20, the belt is advanced toward a development station, indicated generally by the reference letter C. The development station C includes a developer unit indicated by a reference numeral. The developer unit is of a type generally referred to in the art as "magnetic brush development units". Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface.

Developer unit 40 applies toner particles to electrostatic latent image recorded on the photoconductive surface.

After development, the toner image is moved to a transfer station, indicated generally by the reference letter D. Transfer station D includes a transfer zone, generally indicated by reference numeral 64, defining the position at which the toner image is transferred to a sheet of support material, which may be a sheet of plain paper or any other suitable support substrate. A sheet transport apparatus, indicated generally by the reference numeral 48, moves the sheet into contact with photoconductive belt 20. Sheet transport 48 has a belt 54 entrained about a pair of substantially cylindrical rollers 50 and 52. A friction retard feeder 58 advances the uppermost sheet from stack 56 onto a pre-transfer transport 60 for advancing a sheet to sheet transport 48 in synchronism with the movement thereof so that the leading edge of the sheet arrives at a preselected position, i.e. a loading zone. The sheet is received by the sheet transport 48 for movement therewith in a recirculating path. As belt 54 of transport 48 moves in the direction of arrow 62, the sheet is moved into contact with the photoconductive belt 20, in synchronism with the toner image developed thereon.

In transfer zone 64, a corona generating device 66 sprays ions onto the backside of the sheet so as to charge the sheet to the proper magnitude and polarity for attracting the toner image from photoconductive belt 20 thereto.

After the transfer operation, the sheet transport system directs the sheet to a vacuum conveyor, indicated generally by the reference numeral 68. Vacuum conveyor 68 transports the sheet, in the direction of arrow 70, to a fusing station, indicated generally by the reference letter E, where the transferred toner image is permanently fused to the sheet. The fusing station includes a heated fuser roll 74 and a pressure roll 72. The sheet passes through the nip defined by fuser roll 74 and pressure roll 72. The toner image contacts fuser roll 74 so as to be affixed to the sheet. Thereafter, the sheet is advanced by a pair of rolls 76 to a catch tray 78 for subsequent removal therefrom by the machine operator. The last processing station in the direction of movement of belt 20, as indicated by arrow 22, is a cleaning station, indicated generally by the reference letter F. A lamp 80 illuminates the surface of photoconductive belt 20 to remove any residual charge remaining thereon. Thereafter, a rotatably mounted fibrous brush 82 is positioned in the cleaning station and maintained in contact with photoconductive belt 20 to remove residual toner particles remaining from the transfer operation prior to the start of the next successive imaging cycle.

The foregoing description should be sufficient for purposes of the present application for patent to illustrate the general operation of an electrophotographic printing machine incorporating the features of the present invention.

As described, an electrophotographic printing system may take the form of any of several well known devices or systems. Variations of specific electrophotographic processing subsystems or processes may be expected without affecting the operation of the present invention.

Figure 1:
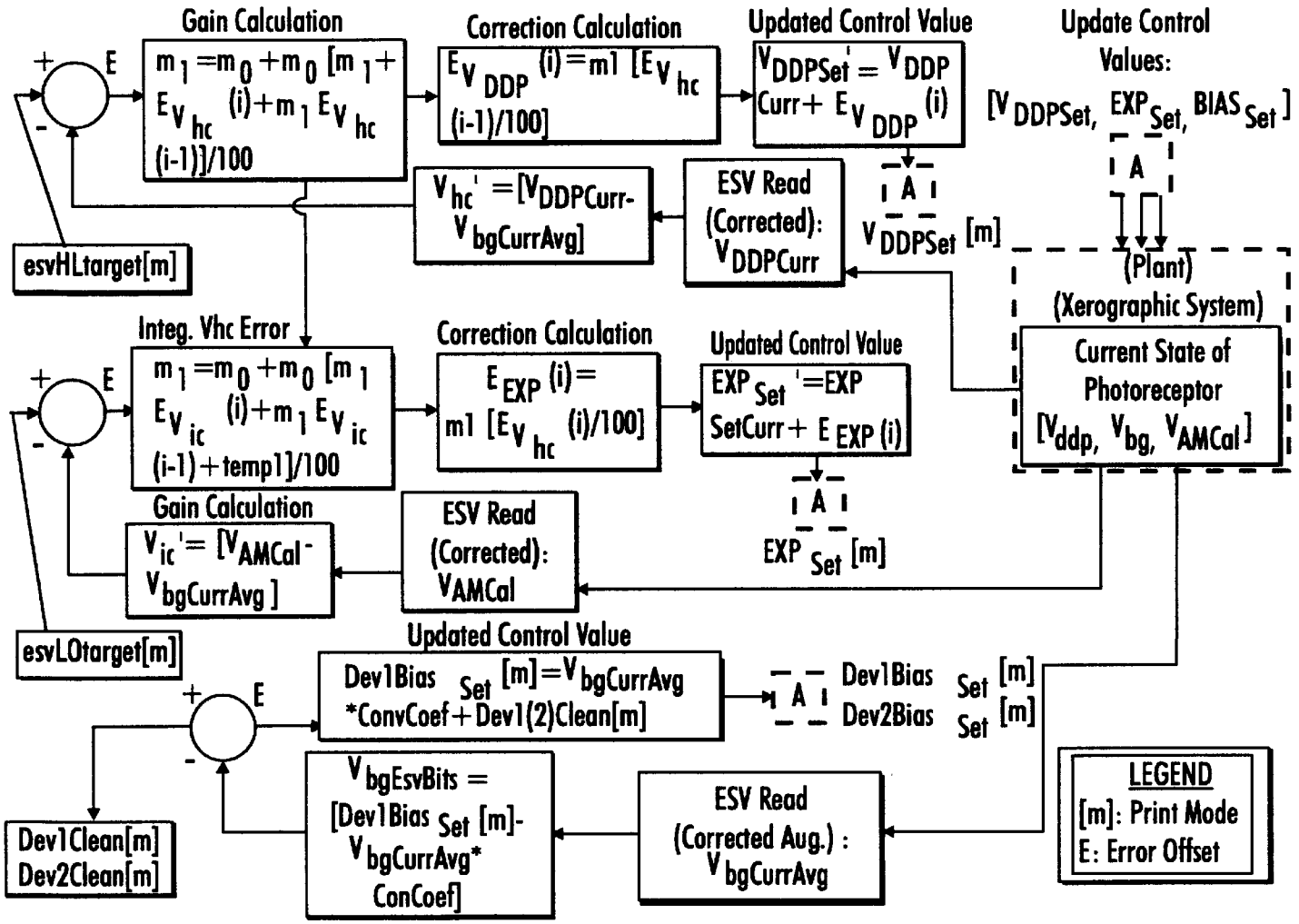
FIG. 1 is a flowchart illustrating the serial process used in the PIDC Controller of the present invention.
Figure 2:
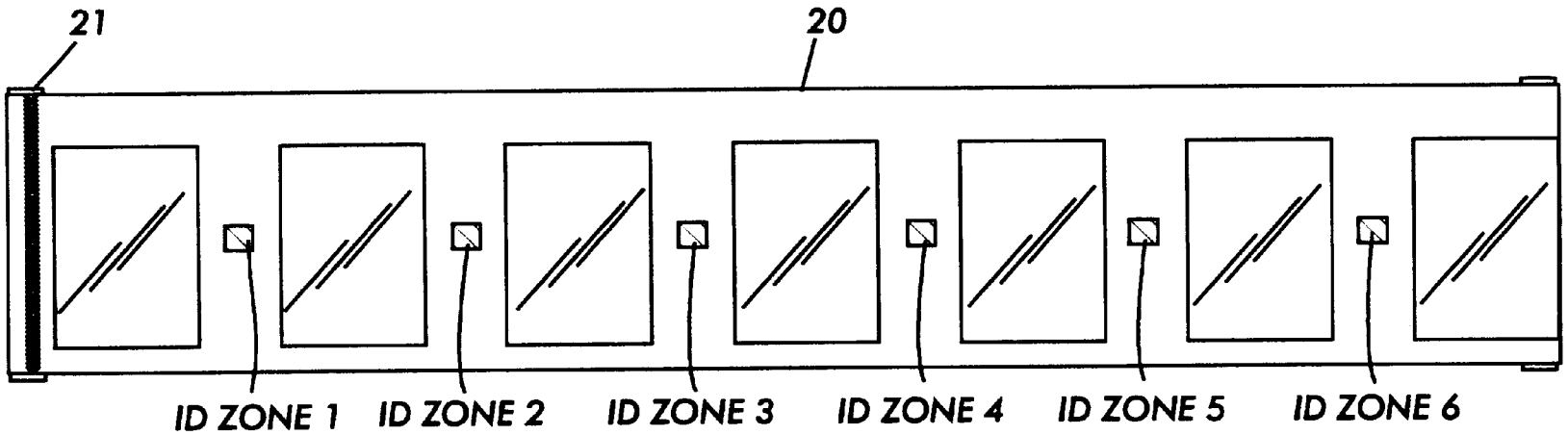
FIG. 2 is a plan view of a control patch on the FIG. 1 photoconductive belt.

Referring to FIGS. 1–3, the concept of the present invention is a PIDC controller, which resides in the IPS. The PIDC controller controls patch generators 110, the exposure level of the ROS, the voltages to the recharging station, and the developer voltage bias. In essence the PIDC Controller is a run time control algorithm designed to maintain optimal xerographic performance throughout the life of photoreceptors. Problems related to residual rise and photoreceptor variability over life are alleviated by the present invention. In brief, a number of control patches are generated during normal production (as shown in FIG. 2), which are then used to monitor the present state of the photoreceptor. This information is then used to determine if any adjustments in such things as $V_{ddp}$: (High Charge Potential), ($V_{bkg}$) Exposure Reference: (Background Charge Potential), and ($V_{AMCal}$) $V_{bias}$: (Analysis Mode Exposure Level Charge Potential, as shown in FIG. 7). The role each of these (Refer to FIG. 1), patches plays in maintaining optimal performance will be described briefly below.

Figure 5:
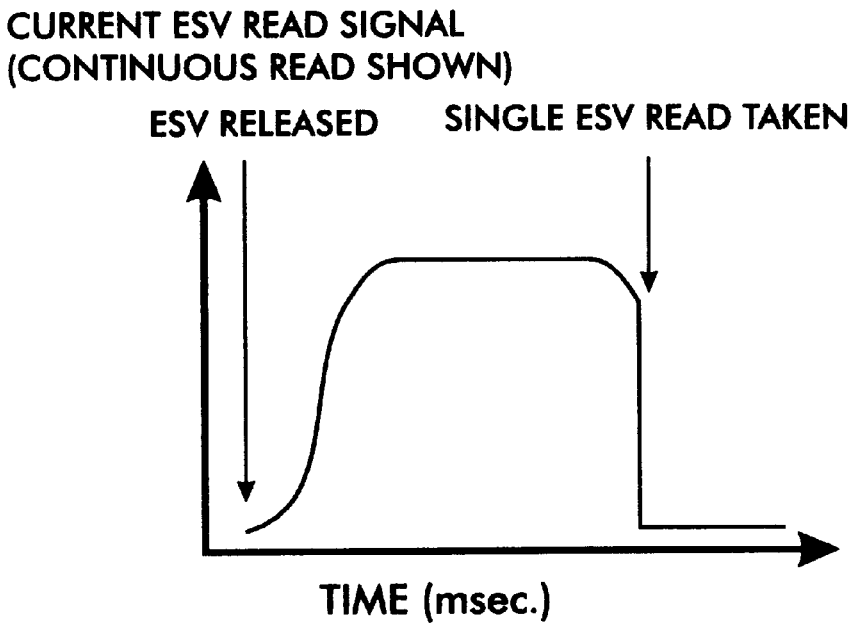
FIGS. 5 and 6 are graphs of ESV readings over a period of time.
Figure 6:
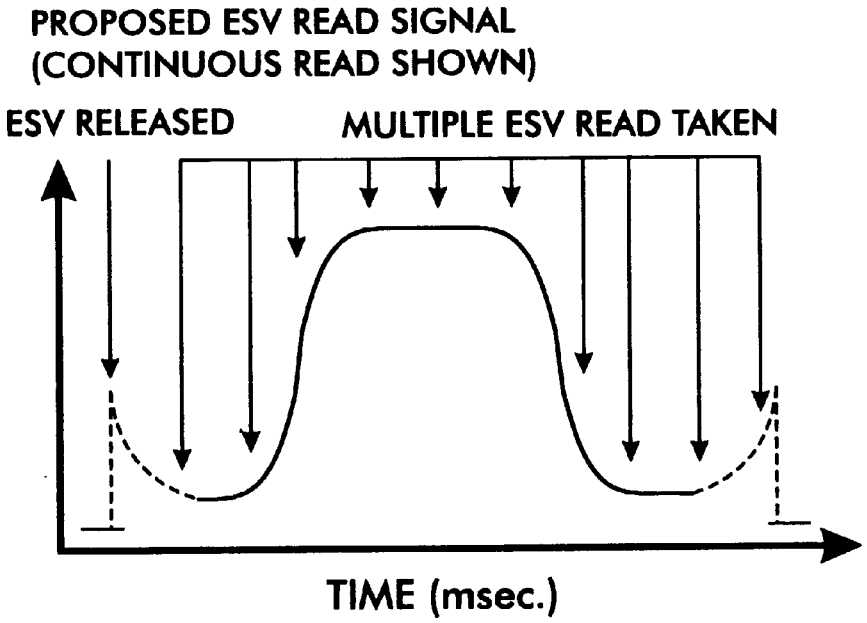

The present invention can use the ESV (Electrostatic Volt Meter) to read each of the three control patches (Vddp, Vamcal, and Vbg) independently and in a single read scenario only. Alternatively, open the ESV read timing interval to extend beyond the current ID (Interdocument) zone. This would include partial trial edge coverage of the pre-ID zone image panel and extend to partial coverage of the post-ID zone image panel. In addition to opening the read interval, single ESV reads per ID zone would be increased to multiple reads taken within this larger "pseudo" ID zone. 2) The results of the multiple reads taken within this new ID zone now require an additional algorithm whose sole purpose is to determine and isolate a valid ESV read for that current ID zone from the multi-read snapshot. Since the end result of ESV controller is to deliver a single, valid read, modifications to the remaining controller architecture would not be required. This algorithm ESV controller consists of an isolation routine that utilizes the image-to-patch-to-image window in locating the optimal patch read which will satisfy the control system, minimize misreads, and filter out noise related disturbances normally associated with single read scenarios; as illustrated in FIGS. 5 and 6.

As mentioned, referring to FIGS. 1, 2, and 7, the present invention uses the following control patch ESV reads ($V_{ddpCurr}$ & $V_{bgCurrAvg}$) as two of its inputs with both of these patches being updated approximately once every cycle of the photoreceptor. Once taken, these reads are then used to calculate the measured High contrast: ($V_{ddpCurr}$–$V_{bgCurrAvg}$) and the measured Rolls 1&2 Cleaning Field: ($Dev_{1\&2BiasSet[m]}$–$V_{bkg}$). The resulting deviation from setpoint, or error (E), for each of the preceding $E_{v_{hc}}$ is then calculated as follows: (=|[$V_{ddp}$–$V_{bkg}$]–svHiTarget[m]|) and ($V_{cln\ 1\&2\ Error}$=|[$V_{bias\ rolls\ 1\&2}$–$V_{bkg}$]–Dev1Clean[m], Dev2Clean[m].|). The aforementioned setpoint or target values used in the error calculations. If an error is not detected, then the present invention continues this polling procedure until an error is discovered.

Should an error exist is High Contrast greater than MIN NVM[382]+/–ESV bits (1 ESV bit=5.88 Volts) or Rolls 1&2 Cleaning Field greater than MIN NVM[382]+/–ESV bits, an AMCal Patch is requested and introduced into the above patch sequence. In other words, should an error in either cleaning field or high contrast be detected greater than the threshold values, the new patch sequence essentially becomes ($V_{ddp}$, $V_{bkg}$, $V_{AMCal}$), as opposed to the ($V_{ddp}$, $V_{bkg}$) mentioned previously. This new three patch sequence is repeated until convergence is achieved.

Once the $V_{AMCal}$ patch is read via the ESV, a similar error in Low Contrast is calculated: ($E_{V_{lc}}$=|[$V_{AMC\ al}$–$V_{bgCurrAvg}$]–esvLoTarget[n]|). Once all three errors are calculated ($V_{HC\ Error}$, $V_{LC\ Error}$, & $V_{cln\ 1\&2\ Error}$), the present invention predicts what the appropriate values of Vddp, Exposure, and Bias Voltage for Rolls 1, 2, & 3 need be to minimize all errors simultaneously. This procedure is repeated until convergence is achieved meaning that the errors are reduced to +/–2 ESV bits for $V_{HC\ Error}$, and +/–1 bit for $V_{cln\ 1\&2\ Error}$ after which the $V_{AMCal}$ patch is terminated and the polling segment of the routine resumes control once again. The process gets invoked just after cycle up but before printing is enabled and terminated at cycle down.

Having in mind the concept and principles of the present invention, it is believed that complete understanding of the invention may be had from description of the following computer pseudo code found in the appendix and with reference to FIGS. 1 and 2.

The PIDC controller in which during normal runtime machine control, two patches are monitored by the ESV (Electrostatic Voltmeter); $V_{ddp}$: which is used for closed loop control of Charge as well as Toner Control once Pgen has reacted on the patch to lower the voltage to that required for Toner Control; and $V_{bg}$: which is used to calculate the current level of the background voltage for the present values of $E_o$ and $V_{ddp}$. From these values, in addition to the current Bias Setpoints for Rolls 1, 2, and 3, errors are calculated for High Contrast and Cleaning Field from the target values set in NVM (Non Volatile Memory). High Contrast is defined as the ($V_{ddp}$) Full Charge Level voltage value minus the ($V_{bg}$) Background Potential voltage value. Cleaning Fields are calculated by subtracting the $V_{bg}$ voltage value from the respective Developer Bias Setpoint voltage values. If either of these errors exceeds an NVM limiting thresholds, 382, 383 then the algorithm requests generation of the Intermediate Exposure Patch ($V_{AMCal}$). This patch now allows an error to also be calculated for the Intermediate Contrast target. Intermediate Contrast is defined as $V_{AMCal}$ voltage value minus the $V_{bg}$ voltage value. Therefore, with error values calculated for High Contrast, Intermediate (low) Contrast, and Cleaning Fields, gain values [$m_1$] are derived which will be used to determine how large the correction to $V_o$ $E_o$, and Bias must be to recenter High Contrast, Intermediate (low) Contrast, and Cleaning Fields back to their prescribed targets. Generation of the $V_{AMCal}$ patch will continue until convergence of both contrast targets as well as cleaning field targets has occurred to some small epsilon, (2 bits for $V_{hc}$, 1 bit for $V_{IC}$, 1 bit for $V_{CLN}$, after which, production of the $V_{AMCal}$ patch will be discontinued leaving only the $V_{ddp}$ and $V_{bg}$ patches to police the system and detect further deviations.

It is, therefore, apparent that there has been provided in accordance with the present invention, a PIDC Controller for an electrophotographic printing machine that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

APPENDIX

MIN NVM

| | |
|---|---|
| m1_0 = 7 | (r) NEW!!! |
| m2_0 = 3 | (r) NEW!!! |
| m1_1 = 5 | (r) NEW!!! |
| m1_2 = 5 | (r) NEW!!! |
| m2_1 = 5 | (r) NEW!!! |
| m2_2 = 5 | (r) NEW!!! |
| Delta_Thresh = 2 | (r) NEW!!! |
| esvHltarget [m] | (r) NOTE:[m] corresponds to current mode. |
| esvLOtarget [m] | (r) |
| dev1Clean [m], dev2Clean [m] | (r) |
| VDDPset [m] | (r,w) |
| DEV1BIASset [m], DEV2BIASset [m] | (r) |
| EXPset [m] | (r) |
| PGENset[m] | (w) |

**********

NOTE: ANYTIME A PATCH IS READ, THE CORRECTED READ SHOULD BE USED TO REDUCE NEW ERRORS INTRODUCED BY THE VARIABILITY IN I.D. ZONE TO IMAGE ZONE CHARACTERISTICS !!!

**********

Description of Algorithm (All Values will have dimensions of Bits (ESV or Bias, however) !!!):

The following patches are made and monitored every belt revolution:

| | | |
|---|---|---|
| Vddp_current | (I.D Zones 2, 4, 6) | !!! USE CORRECTED READ |
| Vbg_current | (I.D Zones 1, 3, 5) | !!! USE CORRECTED READ |

An average of the last (3) Vbg reads is calculated:

Vbg_curr_avg = [Vbg_current(counter) + Vbg_current(counter-1) + Vbg_current(counter−2)]/3

The Delta's w.r.t. the original Vhc target and Vclean are calculated:

Delta_Vhc = (Vddp_current − Vbg_curr_avg) − esvHltarget [m];
Delta_Vcln = (DEV1BIASset [m] − Vbg_curr_avg*59/16) − dev1Clean [m];

Check to see if the threshold bands are exceeded, requiring and adjustment:

++++++++++++++++++++++++++++++++++++++++++++++++++++++++++++++++++++ if ((abs(Delta_Vhc) > x_bits_1) (x_bits_1 is (Delta_Thresh) bit delta)
or (abs (Delta_Vcln) > x_bits_1))
then...

Create a Vamcal patch and read it:

Vamcal_current !!!USE CORRECTED READ

The Delta w.r.t. the original Vic contrast target is calculated:

Delta_Vic = (Vamcal_current − Vbg_curr_avg) − esvLOtarget[m];

Keep generating Vhc, Vamcal, & Vbg patches until all 3 of the following conditions are satisfied simultaneously:

\\\

APPENDIX-continued

```
        Delta_Vddp = m1*Delta_Vhc/100
        Delta_Exp = m2*Delta_Vic/100

        Now calculate new values for VDDPset [m], EXPset [m], DEV1BIASset [m], and
        DEV2BIASset[m]:

        VDDPset[m] = VDDPset[m] + Delta_Vddp
        ESOset[m] = EXPset[m] + Delta_Exp

        Calculate the new Bias Setpoints (m is for current mode):

        DEV1BIASset[m] = Vbg_curr_avg*59/16 + dev1Clean[m])          % Bias for Rolls 1&2
        DEV2BIASset[m] = (Vbg_curr_avg*59/16 + dev2Clean[m])         % Bias for Roll 3

        Update to the new values of VDDPset, EXPset, DEV1BIASset, and DEV2BIASset and
        repeat evaluation until While loop is satisfied.

        End While Loop !!!
        \\\\
```